US006575323B1

(12) United States Patent
Martin et al.

(10) Patent No.: US 6,575,323 B1
(45) Date of Patent: Jun. 10, 2003

(54) CLOSURE WITH DISPENSING FLAP STAY-OPEN CONSTRUCTION

(75) Inventors: Douglas S. Martin, New Castle, PA (US); Joel W. Wennerstrom, Brooklyn, NY (US)

(73) Assignee: Weatherchem Corporation, Twinsburg, OH (US)

( * ) Notice: Subject to any disclaimer, the term of this patent is extended or adjusted under 35 U.S.C. 154(b) by 6 days.

(21) Appl. No.: 09/804,347

(22) Filed: Mar. 12, 2001

(51) Int. Cl.[7] ..... B65D 43/24; B65D 47/08

(52) U.S. Cl. ..... 220/254.3; 220/832; 220/254.2; 222/556

(58) Field of Search ..... 220/254.3, 254.2, 220/831, 832; 215/235, 237; 222/556, 480

(56) References Cited

U.S. PATENT DOCUMENTS

| | | | | | |
|---|---|---|---|---|---|
| 677,466 | A | * | 7/1901 | Ortner | 220/832 |
| 2,833,447 | A | | 5/1958 | Thiele | |
| 3,262,606 | A | * | 7/1966 | Waterman | 222/556 |
| 3,718,238 | A | | 2/1973 | Hazard et al. | |
| 4,354,611 | A | | 10/1982 | Propst et al. | |
| 4,358,032 | A | * | 11/1982 | Libit | 222/556 |
| 4,369,901 | A | | 1/1983 | Hidding | |
| 4,399,928 | A | | 8/1983 | Klingler | |
| 4,441,637 | A | | 4/1984 | Libit | |
| 4,460,100 | A | | 7/1984 | Libit | |
| 4,795,065 | A | * | 1/1989 | Ashizawa et al. | 220/832 |
| 4,895,298 | A | * | 1/1990 | Reil | 220/832 |
| 5,111,961 | A | * | 5/1992 | Van Melle | 220/832 |
| 5,219,100 | A | | 6/1993 | Beck et al. | |
| 5,251,793 | A | | 10/1993 | Bolen, Jr. et al. | |
| 5,395,015 | A | | 3/1995 | Bolen, Jr. et al. | |
| 5,417,350 | A | | 5/1995 | Koo | |
| 5,551,607 | A | | 9/1996 | DeJonge, Sr. et al. | |
| 5,673,811 | A | | 10/1997 | Dickinson et al. | |
| 5,706,981 | A | * | 1/1998 | Nobakht | 222/556 |
| 5,735,418 | A | * | 4/1998 | Erb et al. | 220/832 |
| 5,779,110 | A | | 7/1998 | Brown et al. | |
| 5,971,231 | A | * | 10/1999 | Samz et al. | 222/480 |
| 6,102,257 | A | * | 8/2000 | Goyet | 222/556 |

FOREIGN PATENT DOCUMENTS

| | | | |
|---|---|---|---|
| DE | 4123732 | * | 1/1992 |

* cited by examiner

*Primary Examiner*—Nathan J. Newhouse
(74) *Attorney, Agent, or Firm*—Pearne & Gordon LLP

(57) ABSTRACT

A dispensing closure with a hinged flap for conveniently opening and closing a dispensing aperture. The closure is a one-piece molded part having an integral living hinge. A mechanism for releasably locking the flap in a stay-open position and thereby resisting any tendency of the hinge to resiliently bias the flap towards a closed position is provided. The stay-open mechanism comprises a cooperating pair of surfaces molded into the flap and main body of the closure which are arranged to snap into and out of locking engagement when the flap is deliberately moved into or out of the open position.

10 Claims, 4 Drawing Sheets

CLOSURE WITH DISPENSING FLAP STAY-OPEN CONSTRUCTION

BACKGROUND OF THE INVENTION

The invention relates to plastic dispensing closures or like products with flaps for opening and closing a dispensing aperture.

PRIOR ART

Dispensing closures for bottles, cans and other containers frequently have one or more flaps that can be pivoted between open and closed positions to conveniently dispense product from the container without removing the closure. Examples of the general type of closures under consideration here are disclosed in the following United States Patents, the disclosures of which are incorporated herein by reference: U.S. Pat. Nos. 4,693,399, 4,936,494 and 5,330,082.

Where a flap or flaps are joined to the main body of the closure with an integral hinge, the closure is ordinarily molded of relatively resilient material. The resilient nature of the cap material causes the flap to exhibit a tendency when it is opened and released to spring back or relax towards the closed position. This tendency can be troublesome when the flap assumes a free position which obstructs a dispensing hole or holes in the closure. Numerous techniques have been proposed and used to hold the flap in an open position. Typically, these techniques involve a snap acting or over-center hinge or snap engaging elements apart from the hinge. A specialized hinge can be difficult to mold and can require large areas and/or a location which limits the geometry of the flap on the closure. Frequently, the snap engaging designs require that the closure be formed of two separate parts or have other expensive and/or complex geometries.

SUMMARY OF THE INVENTION

The invention provides a dispensing closure or similar product having a hinged flap with a mechanism to releasably hold the flap open. The disclosed stay-open feature is relatively easy to mold without complex tooling and offers flexibility to the designer in the selection of a stay-open position and can readily be applied to multiple flap closures. Moreover, the stay-open mechanism of the invention is readily adapted to one piece closures.

As disclosed, the invention provides a releasable snap lock mechanism that employs separate formations on the body of the closure and on the flap. The snap lock formation or component on the flap is spaced from the hinge joining the flap to the closure body so that it orbits or pivots around the hinge. The snap lock formation or component on the body lies in the path or orbit of the lock formation on the flap. The body lock formation is located relative to the path of the flap lock formation to determine the position at which the flap is held open and the level of retaining force available to maintain it open.

DESCRIPTION OF THE PREFERRED EMBODIMENTS

Figure 1:
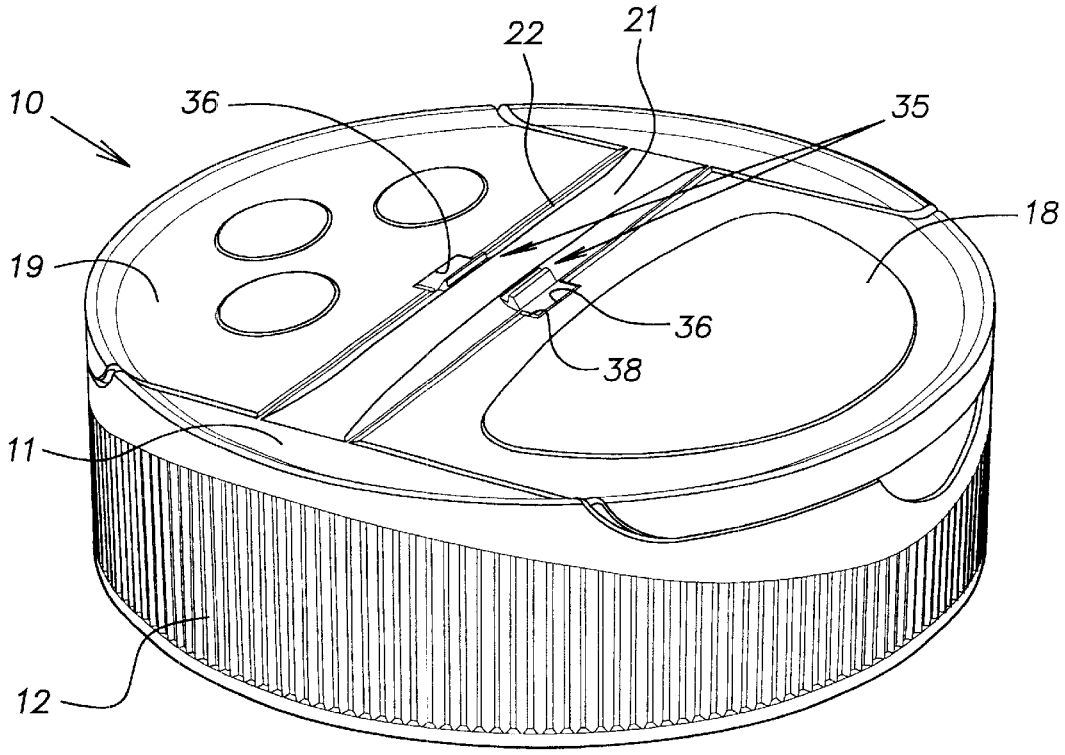
FIG. 1 is a perspective view of a cap in a first embodiment of the invention.
Figure 2:
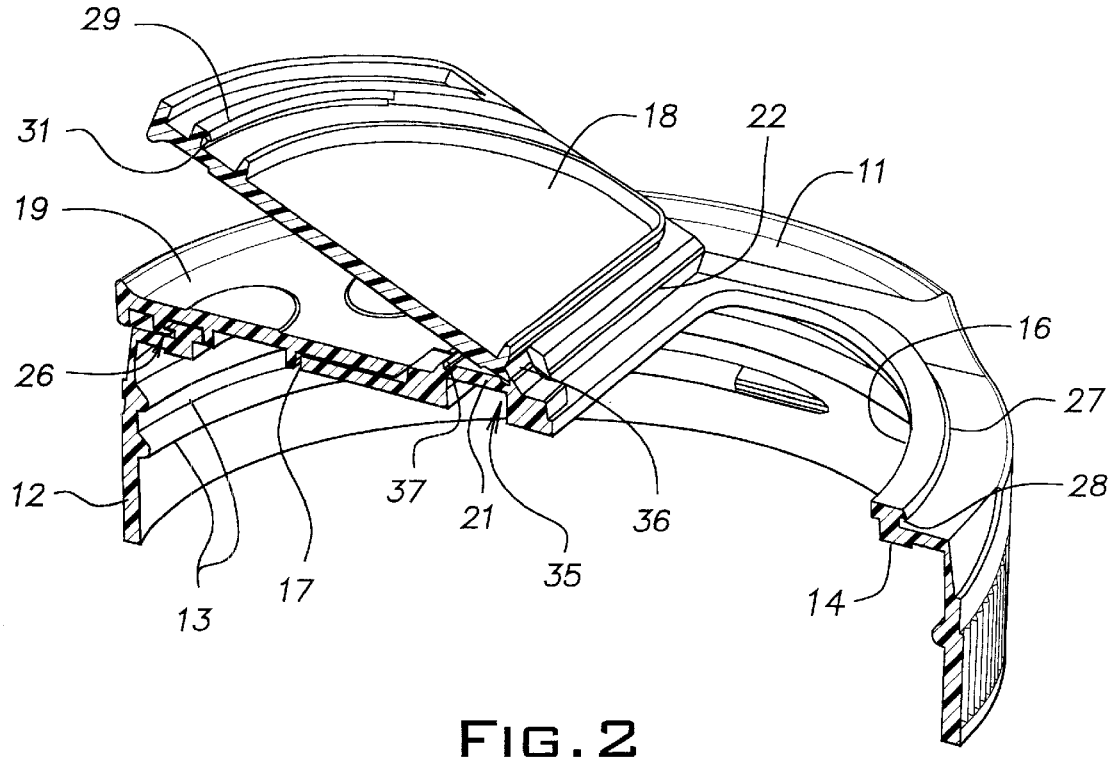
FIG. 2 is a fragmentary perspective sectional view of the cap of FIG. 1 with one flap open.

Referring now to FIGS. 1–4, there is shown a closure or cap 10 in a first embodiment of the invention. The cap 10 is a unitary or one-piece structure preferably formed of an injection molded suitable thermoplastic material such as polypropylene. The cap 10 has a generally circular end wall 11 and a cylindrical skirt 12 depending from the periphery of the end wall. The skirt 12 is formed with internal threads 13 enabling it to be screwed onto a mouth of a container. Caps of this general type are well known in the art and are disclosed, for example, in the U.S. patents cited hereinabove.

A lower face or side of the end wall 11 includes a circumferentially continuous sealing surface 14 that registers with and can engage the mouth of a bottle or container. A removable liner (not shown) such as an induction seal liner, may be positioned in the cap 10 against the sealing surface 14 prior to assembly of the cap on a bottle to assure freshness and tamper evidence by causing the liner to seal on the mouth of the container.

Figure 3:
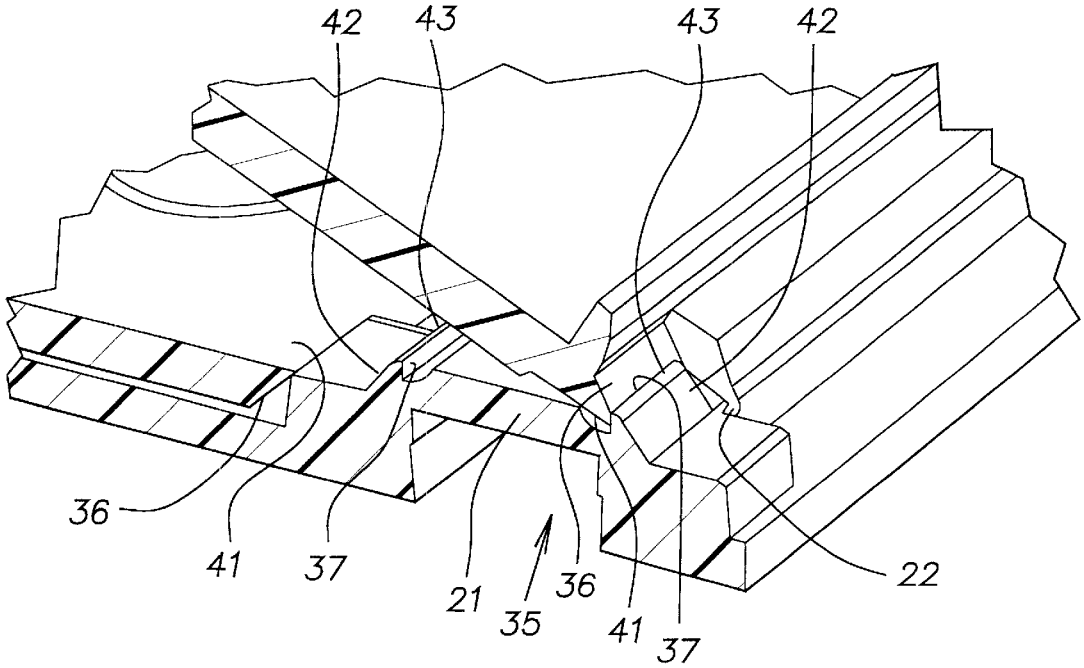
FIG. 3 is an enlarged fragmentary sectional view of the cap of FIG. 1 with one flap open.

The cap 10 illustrated in FIGS. 1–4 is a two-mode design having a relatively large spoon or pouring opening 16 at one side of the end wall 11, and a plurality of sift or shake openings 17 in an opposite side of the end wall. Each of a pair of flaps 18, 19 selectively opens and closes the spoon hole 16 and sift holes 17, respectively. The flaps 18, 19 are integrally joined to a chordal or diametral area 21 of the end wall 11 by respective living hinges 22. The term "chordal", as used herein, is intended to cover the special case where the area 21 is symmetrical with a diametral line such as where, as illustrated, the flaps 18, 19 are essentially of the same size, but also includes arrangements where the flaps are of unequal size and the area is more distinctly offset from a true diametral line. In the illustrated case, the hinges 22 are elongated elements that extend along a major portion of the chordal area 21 and the width of the respective flaps. The hinges 22 in the illustrated embodiment are parallel to each other. The hinges 22 comprise relatively thin, small areas of material. In a plane transverse to their longitudinal direction, the hinges 22 are relatively small in cross-section as shown in FIG. 3 having small dimensions measured in a direction between the flap and the chordal area 21 (FIG. 4) and measured perpendicularly to this direction.

A releasable flap catch mechanism 26 such as disclosed in aforementioned U.S. Pat. No. 5,330,082 is provided to releasably hold each of the flaps 18, 19 closed on the end wall 11 to close their respective apertures or openings 16, 17. The catch mechanism 26 includes a hook-like formation 27 with a downwardly facing surface 28 projecting horizontally on the end wall 11 and a complimentary surface formation 29 including an upwardly facing surface 31 (when the flap is closed) and projecting in a plane parallel to the plane of the flap. When closed, the flap catch surface 31 snaps under the end wall snap catch surface 28.

The invention provides a releasable lock arrangement 35 to releasably hold or lock the flaps 18, 19 open to facilitate dispensing from the container on which the cap 10 is installed. These releasable locks 35, in the embodiment of FIGS. 1–4, associated with each flap 18, 19 comprise a lock surface 36 on a flap 18, 19 and a lock surface 37 on the chordal area 21 of the end wall 11. In the illustrated embodiment, the lock surfaces 36, 37 area positioned adjacent the mid-length of their respective hinges 22. To accommodate these lock surfaces 36, 37 and associated formations, the hinges 22 are interrupted at their mid-length so as to have two parts, one on each side, in the chordal direction, of the lock surfaces 36, 37 and the flap has a rectangular aperture or notch 38 through which the lock surface 37 passes. The lock surfaces 36, 37 are each adjacent an axis of a respective hinge 22. The axis of the hinge 22 can be idealized as existing at the center of its cross-section. The lock surface 36 on the flap 18 is oriented, i.e. facing in the same general direction, as that of the underside of the flap. The lock surface 37 associated with the end wall 11 has an orientation that faces away from the closed position of the flap that it is arranged to hold open.

Figure 4:
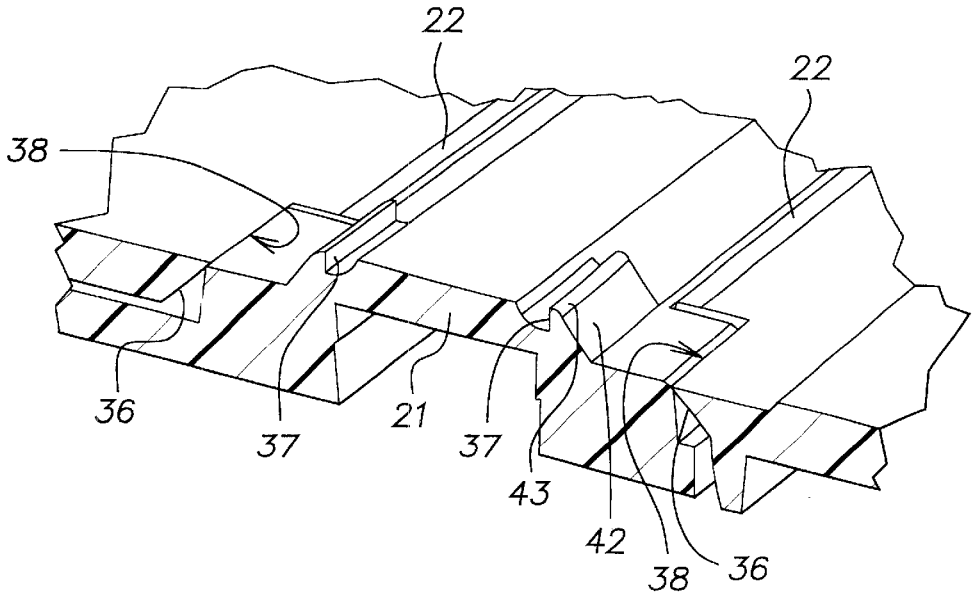
FIG. 4 is a view similar to FIG. 3 but with both of the flaps of the cap closed.

As shown most clearly in FIGS. 3 and 4, the lock surface 36 on the flap is aligned with the lock surface 37 on the end wall in the sense that the surfaces are at the same location along a direction parallel with the axis of the hinge. Stated otherwise, the lock surfaces 36, 37 are in a common plane radial to the axis of the hinge 22.

In the free states of the portions of the end wall 11 and flap 18, 19 providing the lock surfaces 36, 37, the minimum spacing of the lock surface 36 on the flap from the axis of the hinge 22 is less than the maximum spacing of the lock surface 37 on the end wall from the axis of the hinge. This geometry produces an interference between the respective areas of the flap and end wall forming the locking surfaces 36, 37. When a flap 18 or 19 is manually opened and the lock surface 36 on the flap orbits around the hinge axis, the part of the flap forming the locking surface 36 engages the part of the end wall forming the lock surface 37. The flap, end wall and hinge in the zone of the locking surfaces 36, 37 resiliently distort under the influence of a camming action between a surface area 41 on the flap and surface areas 42, 43 on the end wall 11. Upon further manual opening movement of the flap 18, 19, the surface area 41 snaps past the areas 42, 43 and the locking surfaces 36, 37 snap into positions confronting one another and enabling them to releasably hold the respective flap open against any spring back tendency in the hinge 22. To close a flap, a manual force is applied in a closing direction and the snap action reverses. Resilient local distortion in the areas of the lock surfaces 36, 37 and hinge 22 enable the surfaces to again bypass one another.

As seen in FIGS. 1–4, the mid-chordal area 21 of the end wall 11 between the flaps 18, 19 is raised above other areas of the end wall, in the illustrated case, by arching the mid-section of this chordal area slightly upwardly from peripheral areas of the end wall. The increased height or elevation of the mid-section of the chordal area 21 serves to visually integrate the local portions of the end wall that serve to form the lock surface 37 and adjacent camming surfaces 42, 43 for aesthetic purposes. Additionally, the arched chordal area 21 can serve as a back stop to limit opening movement of a flap 18 or 19.

Figure 5:
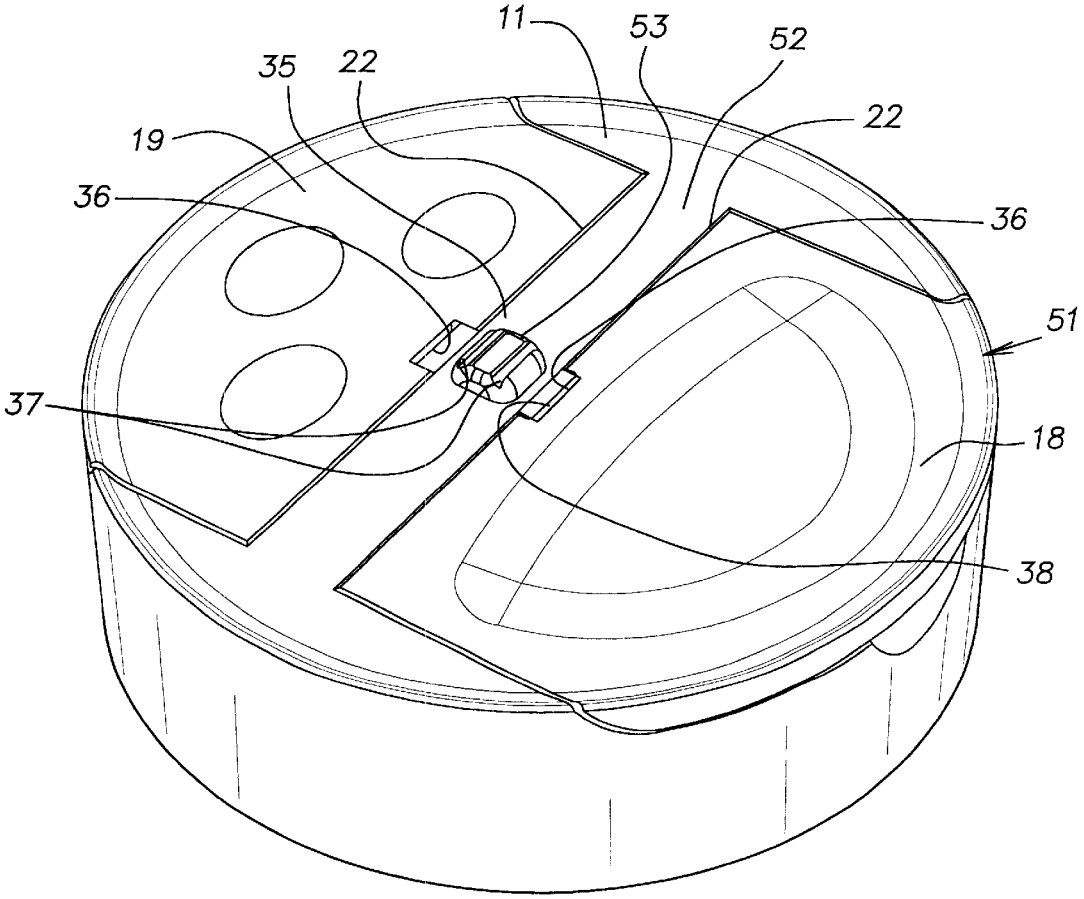
FIG. 5 is a perspective view of a cap in a second embodiment of the invention.

FIG. 5 illustrates a cap 51 similar to the cap 10 detailed in FIGS. 1–4. The same numerals are used in this embodiment as used in the embodiment of FIGS. 1–4 for the same or similar parts. The locking surfaces 37 on a chordal area 52 of the end wall 11 are formed on an integral block or projection 53 at the mid-length part of the chordal area 52. The lock surfaces 36, 37 work to allow the flaps 18, 19 to stay open in the manner described in connection with the embodiment of FIGS. 1–4. 4. The chordal area 52 is generally flat and coplanar with peripheral areas of the end wall at the sides of the flaps 18, 19.

Figure 6:
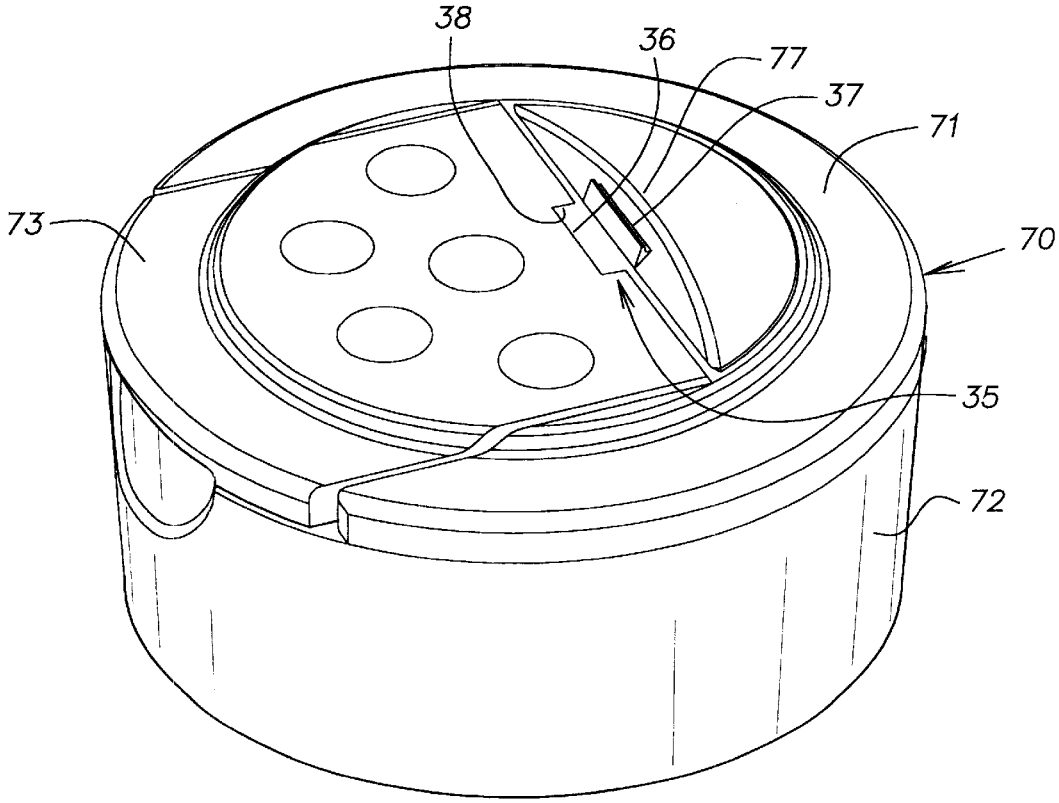
FIG. 6 is a perspective view of a cap in a third embodiment of the invention.
Figure 7:
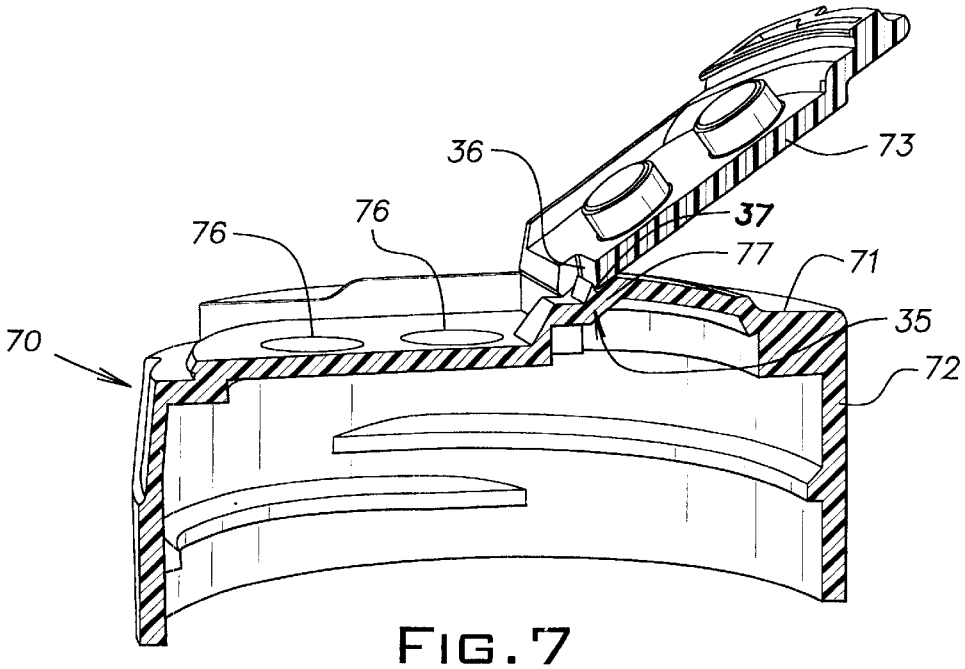
FIG. 7 is a perspective cross-sectional view of the cap of FIG. 6 with a flap open.

FIGS. 6 and 7 illustrate still another embodiment of the invention in which a cap 70 has an end wall 71, a cylindrical internally threaded skirt 72 depending from the periphery of the end wall, and a single flap 73 for selectively opening and closing dispensing apertures 76 in the end wall. The end wall 71 has a chordal area 77 on which a lock surface 37 is formed. The flap 73 includes a cooperating lock surface 36. The lock surfaces 36, 37 serve to releasably hold the flap 73 in an open position, illustrated in FIG. 7, in the manner described above in connection with FIGS. 1–4.

From the foregoing description, it will be understood that the stay-open feature of the flap locking mechanism 35 is relatively simple in construction and readily molded with relatively simple tooling. Still further, the flap locking mechanism 35 assures that a flap will remain open for dispensing purposes. The locking mechanism 35, as demonstrated, can be used with a variety of flap structures including caps with a plurality of flaps. The locking mechanism, although shown disposed at the mid-width of a flap can be disposed at another location or locations on the flap. The lock mechanism 35 can be arranged to hold a flap at a desired angular position, typically greater than 90°.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. For example, the invention, besides being employed with screw-on caps such as disclosed herein, can also be employed with friction or adhesive retained or snap-on closures that fit on or in a container. Accordingly, the patent is not to be limited in scope and effect to the specific embodiments herein shown and described nor in any other way that is inconsistent with the extent to which the progress in the art has been advanced by the invention.

What is claimed is:

1. A one-piece dispensing closure for a package comprising a generally circular end wall, an aperture in the end wall, a flap for selectively opening and closing the aperture by movement between open and closed positions, the flap being connected to the end wall by a hinge integral with the flap and the end wall, the hinge lying along a chordal line on the end wall, the end wall having an outer face, a first lock member on the outer face of the end wall spaced from the hinge on a side of the hinge opposite the flap when the flap is in the closed position, and a second lock member on the flap spaced from the hinge, the location of the hinge relative to both the first and second lock members being fixed when molded and unchanged in use of the closure, the first and second lock members being constructed and arranged relative to the hinge to interengage when the flap is moved to an open position and the second lock member is caused to arcuately pass over an outer part of the first lock member to releasably hold the flap in such open position to facilitate dispensing through said aperture.

2. A closure as set forth in claim 1, wherein said lock members are disposed adjacent a mid-length of the hinge.

3. A closure as set forth in claim 1, wherein said locking members are arranged to retain a flap in an open position wherein it is at least 90° away from its closed position through rotation about said hinge.

4. A closure as set forth in claim 1, wherein said closure includes a pair of flaps.

5. A closure as set forth in claim 1, wherein the locking member on the end wall is a surface which has a generally vertical inclination and wherein the locking member on the flap is a surface that has a generally vertical orientation when the flap is in the open position.

6. A closure as set forth in claim 1, wherein the locking member on the flap is spaced from the hinge a distance less than the distance of the locking surface on the end wall from the hinge.

7. A closure as set forth in claim 1, wherein the locking member on the end wall is a surface that projects upwardly from surrounding adjacent areas of the end wall.

8. A closure as set forth in claim 1, wherein the lock member on the flap is arranged to travel in an arcuate path about the hinge axis when the flap is moved between the closed and open positions.

9. A closure as set forth in claim 8, wherein the lock member on the end wall is arranged in the arcuate path whereby at least one of the portions of the end wall, flap, hinge and lock members is elastically deflected when the lock members are interengaged.

10. A one-piece dispensing closure for a package comprising an end wall, an aperture in the end wall, a flap for selectively opening and closing the aperture, the flap being connected to the end wall by a hinge integral with the flap and the end wall, the end wall having an outer face, a first lock member on the outer face of the end wall spaced from the hinge and a second lock member on the flap spaced from the hinge, the first and second lock members being constructed and arranged to interengage when the flap is moved to an open position and releasably hold the flap in such open position to facilitate dispensing through said aperture, the flap including an aperture through which the locking member on the body is adapted to pass when the flap is moved to its open position.

* * * * *